US009261307B2

(12) United States Patent
Baker et al.

(10) Patent No.: US 9,261,307 B2
(45) Date of Patent: Feb. 16, 2016

(54) SELF CLEANING NOZZLE ARRANGEMENT

(71) Applicant: SHELL OIL COMPANY, Houston, TX (US)

(72) Inventors: Mathew Baker, Gummersbach (DE); Wouter Koen Harteveld, Amsterdam (NL); Hans Joachim Heinen, Gummersbach (DE)

(73) Assignee: Shell Oil Company, Houston, TX (US)

( * ) Notice: Subject to any disclaimer, the term of this patent is extended or adjusted under 35 U.S.C. 154(b) by 278 days.

(21) Appl. No.: 13/921,513

(22) Filed: Jun. 19, 2013

(65) Prior Publication Data

US 2013/0284403 A1 Oct. 31, 2013

Related U.S. Application Data

(62) Division of application No. 12/552,200, filed on Sep. 1, 2009, now Pat. No. 8,490,635.

(60) Provisional application No. 61/095,078, filed on Sep. 8, 2008.

(30) Foreign Application Priority Data

Sep. 1, 2008 (EP) ..... 08163403

(51) Int. Cl.
*B08B 9/00* (2006.01)
*B08B 9/023* (2006.01)
(Continued)

(52) U.S. Cl.
CPC ... *F28C 3/08* (2013.01); *B05B 7/06* (2013.01); *B05B 7/08* (2013.01); *B08B 9/00* (2013.01); *B08B 9/023* (2013.01); *C10J 3/82* (2013.01);
(Continued)

(58) Field of Classification Search
CPC ..... C10J 3/82; C10J 3/84; C10J 2200/152; B08B 9/00; B08B 9/023; B08B 9/027; B08B 9/28; B05B 7/06; B05B 7/08
See application file for complete search history.

(56) References Cited

U.S. PATENT DOCUMENTS 2,480,019 A 8/1949 Grimmeisen
2,797,963 A 7/1957 Wilson
(Continued)

FOREIGN PATENT DOCUMENTS

CN 1203936 1/1999
DE 10004138 A1 8/2001
(Continued)

OTHER PUBLICATIONS

M. Gojc and S. Kozuh; "Development of Direct Reduction Processes and Smelthing Reduction Process for the Steel Production"; Kem. Ind.; vol. 55(1); pp. 1-10; 2006.

*Primary Examiner* — Saeed T Chaudhry

(57) ABSTRACT

The invention is directed to an arrangement of two conduits, wherein the conduits are positioned parallel with respect to each other and wherein each conduit is provided with means suitable to remove solids from its surface and positioned along the length of one of the two sides of the conduit, wherein the means are one or more pairs of oppositely oriented nozzles, each nozzle having an outflow opening for gas directed, along the surface of the conduit, towards the outflow opening of the other nozzle of said pair, wherein the pairs of oppositely oriented nozzles of one conduit are arranged in a staggered configuration relative to the pairs of oppositely oriented nozzles of the other conduit.

6 Claims, 2 Drawing Sheets

(51) Int. Cl.

| | |
|---|---|
| ***C10J 3/82*** | (2006.01) |
| ***B05B 7/08*** | (2006.01) |
| ***F28C 3/08*** | (2006.01) |
| ***B05B 7/06*** | (2006.01) |
| ***C10J 3/84*** | (2006.01) |
| ***C10K 1/10*** | (2006.01) |
| ***F23J 3/02*** | (2006.01) |
| ***F28G 1/16*** | (2006.01) |
| ***F28F 1/00*** | (2006.01) |

(52) U.S. Cl.

CPC . *C10J 3/84* (2013.01); *C10K 1/101* (2013.01); *F23J 3/023* (2013.01); *F28F 1/00* (2013.01); *F28G 1/16* (2013.01); *C10J 2300/1884* (2013.01)

(56) References Cited

U.S. PATENT DOCUMENTS

| | | | | |
|---|---|---|---|---|
| 2,900,430 | A | | 6/1960 | Hardgrove |
| 2,940,430 | A | | 6/1960 | Hardgrove |
| 2,970,772 | A | | 2/1961 | Boosinger et al. |
| 2,998,464 | A | | 8/1961 | Burleson et al. |
| 3,541,788 | A | | 11/1970 | Schutz |
| 3,988,421 | A | | 10/1976 | Rinaldi |
| 4,054,424 | A | | 10/1977 | Staudinger et al. |
| 4,083,932 | A | | 4/1978 | Maraco et al. |
| 4,510,874 | A | | 4/1985 | Hasenack |
| 4,523,529 | A | | 6/1985 | Poll |
| 4,640,460 | A | | 2/1987 | Franklin, Jr. |
| 4,775,392 | A | | 10/1988 | Cordier et al. |
| 4,848,982 | A | | 7/1989 | Tolle et al. |
| 4,859,213 | A | | 8/1989 | Segerstrom |
| 4,887,962 | A | | 12/1989 | Hasenack et al. |
| 4,890,793 | A | | 1/1990 | Fuglistaller et al. |
| 4,897,090 | A | | 1/1990 | Liu et al. |
| 4,973,337 | A | * | 11/1990 | Jokisch et al. ..... 48/87 |
| 5,124,134 | A | | 6/1992 | Come |
| 5,329,760 | A | | 7/1994 | Bradley et al. |
| 5,433,760 | A | | 7/1995 | Doering et al. |
| 5,534,659 | A | | 7/1996 | Springer et al. |
| 5,648,048 | A | | 7/1997 | Kuroda et al. |
| 5,732,885 | A | | 3/1998 | Huffman |
| 5,765,510 | A | | 6/1998 | Krowech et al. |
| 5,803,937 | A | | 9/1998 | Hartermann et al. |
| 5,919,406 | A | | 7/1999 | Bachofen |
| 5,976,203 | A | | 11/1999 | Deeke et al. |
| 6,006,999 | A | | 12/1999 | Tiessen et al. |
| 6,062,547 | A | | 5/2000 | Nilsson |
| 6,149,137 | A | | 11/2000 | Johnson et al. |
| 6,755,980 | B1 | | 6/2004 | Van Den Born et al. |
| 2001/0009648 | A1 | | 7/2001 | Bisgrove et al. |
| 2004/0222317 | A1 | | 11/2004 | Huffman |
| 2006/0076272 | A1 | | 4/2006 | Stil |
| 2006/0260191 | A1 | | 11/2006 | Van Den Gerg et al. |
| 2007/0294943 | A1 | | 12/2007 | Van Den Berg et al. |

FOREIGN PATENT DOCUMENTS

| | | | |
|---|---|---|---|
| EP | 0318071 | | 5/1989 |
| EP | 0400740 | | 5/1990 |
| EP | 0551951 | | 7/1995 |
| EP | 0926441 | | 12/2002 |
| GB | 2061758 | | 5/1981 |
| JP | 53110967 | | 9/1978 |
| JP | 62280578 | | 12/1987 |
| JP | 2657157 | | 9/1997 |
| JP | 2731384 | B2 | 3/1998 |
| JP | 10316976 | | 12/1998 |
| KR | 20030067201 | A | 8/2003 |
| WO | 9317759 | | 9/1993 |
| WO | 0037170 | | 6/2000 |
| WO | 03080221 | | 10/2003 |
| WO | 2004005438 | | 1/2004 |
| WO | 2005052095 | | 6/2005 |
| WO | 2006117355 | | 11/2006 |
| WO | 2007125046 | | 11/2007 |
| WO | 2007125047 | | 11/2007 |
| WO | WO-2007/125046 | * | 11/2007 |
| WO | WO-2007/125047 | * | 11/2007 |

* cited by examiner

FIG. 5
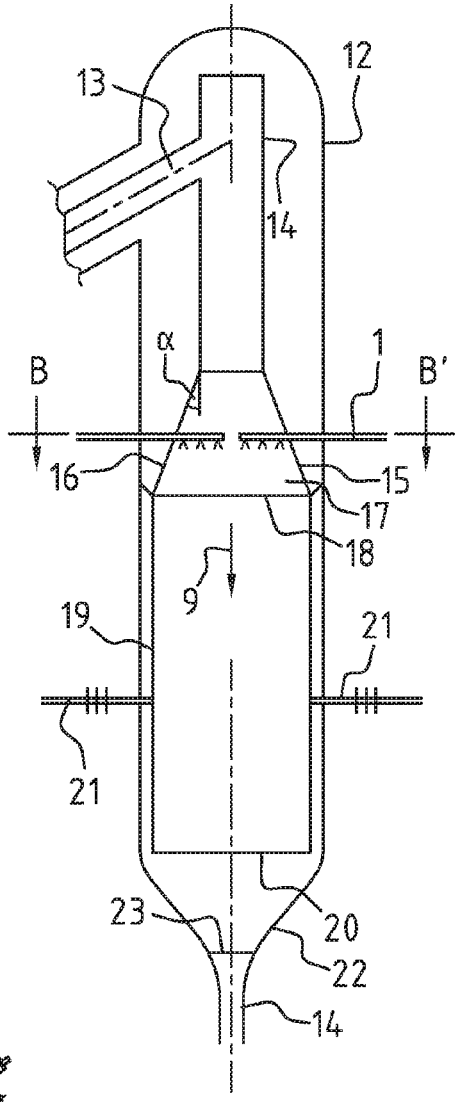
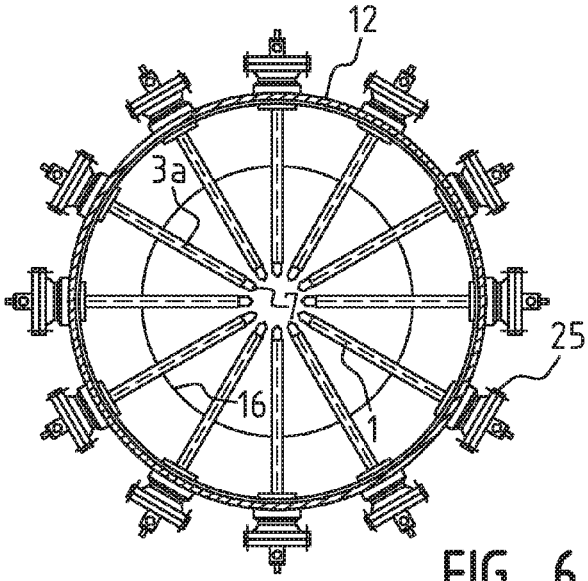
FIG. 6

SELF CLEANING NOZZLE ARRANGEMENT

This application is a divisional of application Ser. No. 12/552,200 filed Sep. 1, 2009 which claims the benefit of European Application No. 08163403.2, filed Sep. 1, 2008 and U.S. Provisional Application No. 61/095,078, filed Sep. 8, 2008.

BACKGROUND

The invention is directed to a nozzle arrangement provided with means suitable to remove solids from its surface.

WO-A-2007125046 and WO-A-2007125047 describe a gasification reactor wherein a hot synthesis gas is produced by gasification of a coal feed. The hot synthesis gas is reduced in temperature by injecting a mist of water droplets into the stream of hot gas. A problem of having injection means for such a mist in the flow path for hot synthesis gas is that ash may accumulate on said means.

Means for removing ash in coal gasification processes are known. U.S. Pat. No. 5,765,510 describes a retractable soot blower for avoiding and dislodging accumulated soot and ash in the heat recovery devices as used in a coal gasification process.

A problem of using the soot blower of U.S. Pat. No. 5,765,510 in a process of either WO-A-2007125046 and WO-A-2007125047 is that the local gas flow direction will be disturbed. This local disturbance of the gas flow may result in that ash and not fully evaporated water comes into contact with the walls of the vessel. It is known that ash and liquid water can cause fouling that is not easy to remove.

GB-A-2061758 describes a radiant boiler wherein numerous nozzles are present to blow gas along the heat exchange surfaces to avoid solids accumulating on said surfaces. A problem with such an arrangement is that solids may still accumulate on the nozzles themselves.

SUMMARY OF THE INVENTION

The present invention provides an arrangement having nozzles to remove solids from an element's surface wherein the local gas flow around said element is disturbed less and wherein solids do not accumulate on the nozzles themselves.

In one embodiment, the invention provides an arrangement of two conduits, wherein the conduits are positioned parallel with respect to each other and wherein each conduit is provided with one or more pairs of oppositely oriented nozzles suitable to remove solids from its surface and positioned along the length of one of the two sides of the conduit, each nozzle having an outflow opening for gas directed, along the surface of the conduit, towards the outflow opening of the other nozzle of said pair, wherein the pairs of oppositely oriented nozzles of one conduit are arranged in a staggered configuration relative to the pairs of oppositely oriented nozzles of the other conduit.

BRIEF DESCRIPTION OF THE DRAWINGS

FIG. 5 shows a vertical positioned quenching vessel.

FIG. 6 shows the cross-sectional view BB' of the quench vessel of FIG. 5.

DETAILED DESCRIPTION

Figure 1:
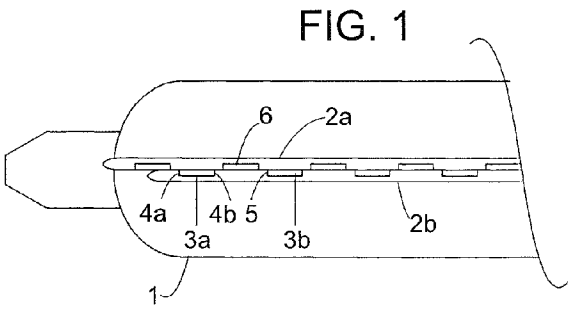
FIG. 1 shows the top view of a spray conduit according to the invention.

Applicants found that by having a pair of nozzles having outflow openings directed to each other the impact on the overall gas flow is low while at the same time sufficient cleaning is achieved in the space between said nozzles and cleaning is achieved of the nozzles as present on a parallel conduit. Other advantages shall be discussed when describing some of the preferred embodiments.

The nozzles are positioned along the length of one of the two sides of the conduit. With a side is here meant the part of the conduit, which is obtained when dividing the conduit along its length. Such a conduit may be any conduit as present in a gas flow path for a gas containing solids, which may accumulate on the side of said conduit having the pair of nozzles. Two rows of oppositely oriented nozzles run parallel along the length of the conduits, wherein the pairs of oppositely oriented nozzles as present in one row are arranged in a staggered configuration relative to the pairs of oppositely oriented nozzles as present in the other row. This staggered configuration results in that one nozzle in one row is substantially in the conically formed flow path of the gas flow exiting one pair of nozzles as present on the parallel other row. This results in that the gas exiting the nozzles not only removes solids from the conduit but also from the nozzles themselves. It is clear that in such a configuration both parallel conduits are positioned in close vicinity of each other, preferably within 10 cm, more preferably within 5 cm of each others heart line.

The invention is also directed to a preferred spray conduit as the element according to the invention having more than one laterally spaced nozzle along one side of the spray conduit for atomization and spraying liquid in a direction away from the longitudinal axis of the conduit. This spray conduit is provided with the arrangement as described above along the other side of the spray conduit. The preferred spray conduit comprises a first co-axial passage for supply of an atomization gas and a second co-axial passage present in said first passage for supply of a liquid. Furthermore the spray conduit has more than one laterally spaced nozzle for atomization and spraying liquid in a direction away from the longitudinal axis of the spray conduit attached to the first passage. These nozzles having an inlet for liquid fluidly connected to said second passage, an inlet for atomization gas fluidly connected to the first passage, a mixing chamber wherein atomization gas and liquid mix and an outlet for a mixture of atomization gas and liquid.

The invention is also directed to a quench vessel provided with an inlet for gas and an outlet for gas defining a gas flow path between said inlet and outlet, wherein in said gas flow path one or more spray conduits as described above are positioned. Preferably the quench vessel is provided at its upper end with a first internal tubular wall part which wall part has an opening fluidly connected to the inlet for gas and wherein the tubular wall part is connected at its lower end with a divergent conical part having walls which are inclined outwardly in the direction of the gas flow path, wherein in the space enclosed by the divergent conical part an arrangement of spray conduits is positioned. Applicants found that by having the arrangement of spray conduits present in the space enclosed by the divergent conical part less or no deposition of a mixture of ash and liquid water will occur. This is very important to achieve a continuous operation for a prolonged period of time.

A preferred arrangement of spray conduits comprises a number of radially disposed spray conduits extending from the wall of the quench vessel and through openings in the wall of the divergent conical part to a central position. The spray conduits are provided with one or more nozzles directed in the flow path direction.

Preferably from 4 to 16 spray conduits are present. Each spray conduit may suitably have from 3 to 10 nozzles. Preferably the nozzle closest to the central position has a slightly tilted main outflow direction between the direction of the flow path and the central position. The arms are preferably present in one plane perpendicular to the flow path. Alternatively, the arms may be present in different planes, for example in a staggered configuration. The quench vessel may be advantageously used as the quench vessel in a configuration and process as described in the earlier referred to WO-A-2007125046.

In addition the invention is also directed to a heat exchanger vessel provided with an inlet for gas and an outlet for gas defining a gas flow path between said inlet and outlet. In said flow path a conduit as described above is positioned, through which conduit in use a cooling medium flows. Preferably the arrangement as described above is positioned along the length of one of the two sides of the conduit. The side at which the arrangement is provided is obviously the side most prone to deposition of solids. Typically this is the upstream side of a conduit relative to the flow path in the heat exchanger. In some circumstances solids may accumulate at other positions due to recirculation phenomena and obviously such arrangements will then be positioned at these positions.

The invention is also directed to a process to remove solids from an element by periodically ejecting a gas flow from one or more pairs of oppositely oriented nozzles, wherein each nozzle ejects the gas flow along the surface of the element, towards the outflow opening of the other nozzle of said pair. The element is preferably the element as described above.

The invention is also directed to a process to cool a mixture comprising carbon monoxide, hydrogen and ash solids in a heat exchanger vessel as described above, wherein the mixture flows through the vessel along the gas flow path and wherein cooling takes place by means of indirect heat exchange between the mixture and the conduits, wherein water flows as the cooling medium through the conduits and wherein ash solid are removed from the conduit exterior surface or part of the conduit exterior surface by periodically ejecting a gas flow from the pairs of oppositely oriented nozzles.

The invention is also directed to a process to cool a mixture comprising carbon monoxide, hydrogen and ash solids in a quench vessel as described above, wherein the mixture flows through the vessel along the gas flow path and wherein cooling takes place by spraying liquid water into the gas flow via the laterally spaced nozzles substantially in the direction of the gas flow, wherein ash solids are removed from the conduit exterior surface or part of the conduit exterior surface by periodically ejecting a gas flow from the pairs of oppositely oriented nozzles.

The mixture comprising carbon monoxide, hydrogen and ash solids preferably has a pressure of between 2 and 10 MPa and a temperature of between 500 and 900° C. and more preferably between 600 and 800° C. The temperature of the mixture after cooling is preferably between 200 and 600° C. and more preferably between 300 and 500° C. This mixture is preferably obtained when gasifying an ash containing carbonaceous feedstock. Examples of such feedstocks are coal, coke from coal, coal liquefaction residues, petroleum coke, soot, biomass, and particulate solids derived from oil shale, tar sands and pitch. The coal may be of any type, including lignite, sub-bituminous, bituminous and anthracite. Preferably a gasification reactor configuration is used wherein the hot gas is discharged and cooled separately from the slag. Examples of such gasification reactors are described in the earlier referred WO-A-2007125046. Thus excluded from this preferred embodiment are gasification reactors having a water quench zone at the lower end through which hot gas is passed and wherein slag and gas are reduced in temperature simultaneously. Examples of such gasification reactors are described in US-A-20050132647 or US-A-20080005966.

In the above processes gas is preferably ejected from the nozzles continuously or periodically. If gas is ejected periodically the frequency shall depend on the fouling properties of the ash. The optimal frequency can be easily determined by the skilled person by simple experimentation. The exit velocity of the gas as it is ejected from the nozzles is preferably above 50 m/s and more preferably above 100 m/s. If the environment has a high temperature, as in the above processes to cool a mixture comprising carbon monoxide, hydrogen and ash, the conduits and nozzles are preferably cooled. Cooling is preferably effected by maintaining a continuous gas stream through the nozzles, wherein the gas exiting the nozzles has a low velocity, preferably below 20 m/s. Maintaining such a low velocity gas stream has the additional advantage that blockage of the nozzle openings is avoided. Periodically the gas exit velocity is increased to remove solids according to the invention. The gas may be any gas, preferably any gas that is inert in the process. Preferred gasses are nitrogen, carbon dioxide, carbon monoxide, hydrogen and mixtures of carbon monoxide and hydrogen.

FIG. 1 shows the top view of a spray conduit (1). Fixed to said spray conduit (1) two parallel arranged conduits (2*a*, 2*b*) are shown. Each conduit (2*a*, 2*b*) is provided with a number of pairs of nozzles (3*a*, 3*b*). Preferred nozzles (3*a*) have two outflow openings (4*a*, 4*b*). As shown the outflow opening (4*b*) of a single nozzle (3*a*) is directed towards the outflow opening (5) of the other nozzle (3*b*) of said pair. In the embodiment shown in FIG. 1 the pairs of nozzles (3*a*, 3*b*) are arranged in a staggered configuration. As shown the two parallel conduits (2*a*, 2*b*) are in close vicinity of each other such that the staggered arranged pair of nozzles (3*a*, 3*b*) present on conduit (2*b*) can both remove solids from the spray conduit (1) and from the intermediate positioned nozzle (6) as present on the other conduit (2*a*).

Figure 2:
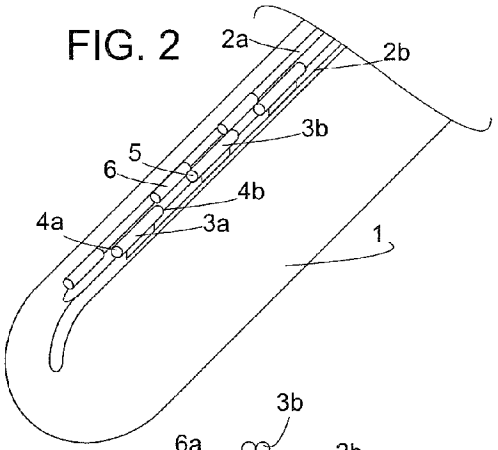
FIG. 2 is a three dimensional representation of the spray conduit of FIG. 1.

FIG. 2 is a three dimensional representation of the spray conduit (1) of FIG. 1. The reference numbers have the same meaning.

Figure 3:
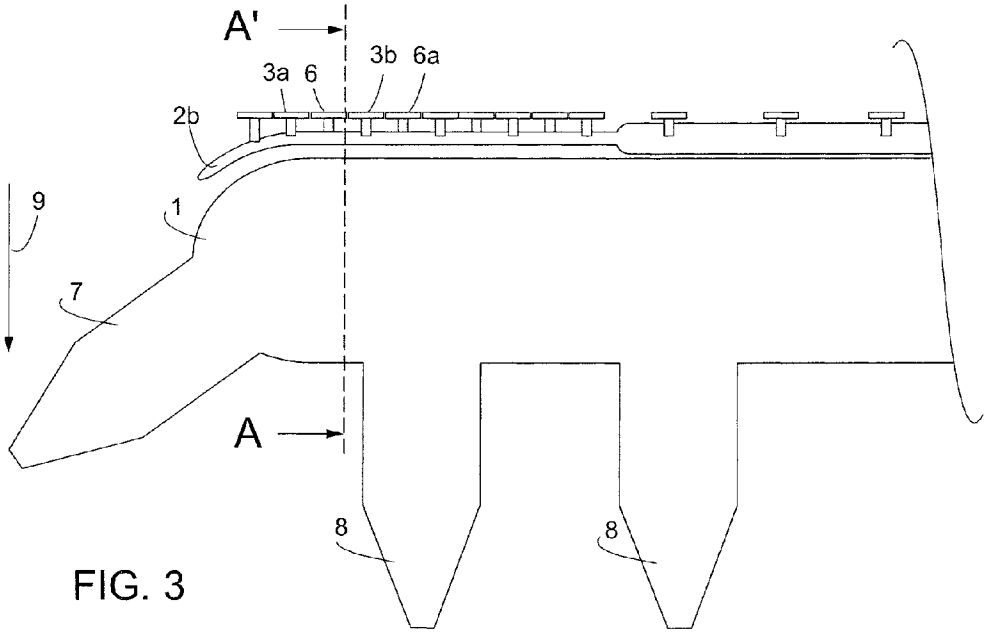
FIG. 3 is the side view of the spray conduit of FIG. 1.

FIG. 3 is the side view of the spray conduit (1) of FIG. 1. FIG. 3 also shows nozzle (6*a*) forming a pair of nozzles with nozzle (6). FIG. 3 also shows a nozzle (7) at the outer end of the spray conduit (1) having a slightly tilted main outflow direction with respect to the direction of the flow path (9). The spray conduit (1) is furthermore provided with a number of spray nozzles (8) having a main outflow direction in line with the direction of the gas flow path (9).

Figure 4:
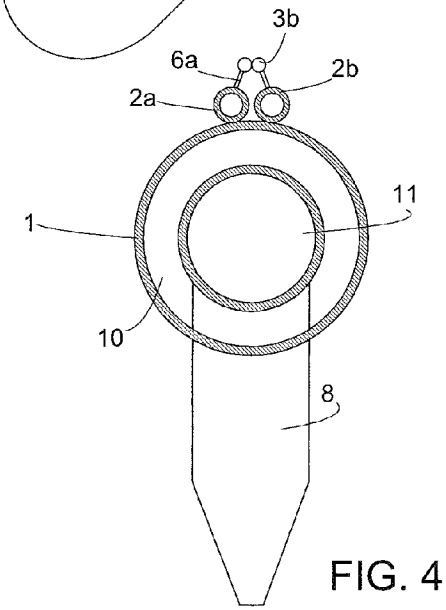
FIG. 4 shows a cross-sectional view AA' of the spray conduit as shown in FIG. 3.

FIG. 4 shows a cross-sectional view AA' of the spray conduit (1) as shown in FIG. 3. The spray conduit (1) has a first co-axial passage (10) for supply of an atomization gas and a second co-axial passage (11) for supply of a liquid. The second passage (11) is present in said first passage (10).

FIG. 5 shows a vertical positioned quenching vessel (12). Vessel (12) has an inlet (13) for hot gas at its upper end, an outlet (14) for cooled gas at its lower end defining a gas flow path (9) for a gas flow directed downwardly. Vessel (12) is also provided with several spray conduits (1) for injecting a quench medium into the gas flow path (9). FIG. 5) shows a first internal tubular wall part (14) fluidly connected to the inlet (13) for hot gas. Tubular wall part (14) is connected at its lower end with a divergent conical part (15) having walls (16), which are inclined outwardly in the direction of the gas flow path (9). As shown, the spray conduits (1) are present in the space (17) enclosed by the divergent conical part (15).

Divergent conical part (15) is followed at its lower end (18) by a second tubular inner wall (19). The lower open end (20) of the second tubular inner wall (19) is in fluid communication with the outlet (14) for cooled gas.

FIG. 5 also shows angle α, which is about 7.5° in the illustrated embodiment. The second tubular inner wall (19) is provided with one or more rappers (21). Optionally the first tubular inner wall part (14) and the diverging conical part (15) can also be provided with one or more rappers. The lower end of vessel (12) suitably has a tapered end (22) terminating in a central opening 23 as the outlet (14) for cooled gas.

FIG. 5 also shows that the inlet (13) for hot gas is provided at side wall of the upper end of vessel (12). Such a configuration is preferred to connect the quench vessel (12) via a connecting duct to a gasification reactor (not shown).

FIG. 6 shows the cross-sectional view BB' of the quench vessel of FIG. 5. It shows 12 radially disposed spray conduits (1) provided with downwardly directed nozzles as seen from above. The arms are fixed to the wall of vessel (12) and intersect with wall (16) of the divergent conical part (15) and extend to a central position. The spray conduits (1) are connected to the vessel via a flange (25) and can therefore be easily removed for repairs or maintenance. The nozzles (3*a*, 3*b*, 6 etc.) to remove solids are represented by the dotted line.

What is claimed is:

1. A process to cool a mixture comprising carbon monoxide, hydrogen and ash solids in a quench vessel, comprising the steps of:

the mixture flowing through the vessel along a gas flow path;

cooling the mixture by spraying liquid water into the gas flow via laterally spaced spray elements substantially in the direction of the gas flow, providing the spray elements with a nozzle arrangement comprising two conduits;

removing ash solids from an exterior surface of the spray elements or part of an exterior surface of the spray elements by periodically ejecting a gas flow from the corresponding nozzle arrangement, wherein the conduits of the nozzle arrangements are positioned parallel with respect to each other along the spray elements and wherein each conduit is provided with one or more pairs of oppositely oriented nozzles suitable to remove solids from the exterior surface of the spray element and positioned along the length of the spray element, wherein each nozzle has an outflow opening for gas directed, along the surface of the spray element, towards the outflow opening of the other nozzle of said pair, wherein the pairs of oppositely oriented nozzles of one conduit are arranged in a staggered configuration relative to the pairs of oppositely oriented nozzles of the other conduit.

2. The process according to claim 1, wherein the mixture comprising carbon monoxide, hydrogen and ash solids has a pressure of between 2 and 10 MPa and a temperature of between 500 and 900° C., and wherein the temperature of the mixture after cooling is between 200 and 600° C.

3. The process according to claim 2, wherein the mixture comprising carbon monoxide, hydrogen and ash solids has a temperature of between 600 and 800° C. and wherein the temperature of the mixture after cooling is between 300 and 500° C.

4. The process according to claim 1, the two conduits being arranged in close vicinity with respect to each other such that the nozzles on one of the conduits can remove solids from the spray element and from an intermediate positioned nozzle as present on the other conduit.

5. The process according to claim 4, the hart line of one conduit being within a distance of 10 cm of the hart line of the other conduit.

6. The process according to claim 1, the spray elements being provided with a number of spray nozzles having a main outflow direction in line with the direction of the gas flow path.

* * * * *